United States Patent [19]

Sharp

[11] Patent Number: 5,056,546

[45] Date of Patent: Oct. 15, 1991

[54] NON-SLIP WALKING ASSIST DEVICE

[76] Inventor: David Sharp, Rte. 7, Byrd Ave., Chippewa Falls, Wis. 54729

[21] Appl. No.: 503,262

[22] Filed: Apr. 2, 1990

[51] Int. Cl.[5] ..... A61H 3/02

[52] U.S. Cl. ..... 135/68; 135/81; 135/70; 74/89.15

[58] Field of Search ..... 135/70, 78, 81, 84, 135/67, 68; 74/89.15, 424.8 R, 85, 88

[56] References Cited

U.S. PATENT DOCUMENTS

| | | | |
|---|---|---|---|
| 578,583 | 3/1897 | Robinson | 135/70 |
| 1,298,721 | 4/1919 | Hughes | 135/81 |
| 2,358,853 | 9/1944 | Dunnicliff | 135/70 |
| 2,371,246 | 3/1945 | McGrory et al. | 135/70 |
| 2,665,701 | 1/1954 | Thackery | 135/70 |
| 2,682,275 | 6/1954 | Eyrich | 135/70 |
| 3,448,749 | 6/1969 | Stark | 135/70 |
| 3,881,504 | 5/1975 | Pfaff | 135/70 |
| 4,364,405 | 12/1982 | Norwood et al. | 135/70 |
| 4,434,808 | 3/1984 | Burak | 135/70 X |
| 4,640,301 | 2/1987 | Battiston, Sr. et al. | 135/67 |

FOREIGN PATENT DOCUMENTS

| | | | |
|---|---|---|---|
| 743690 | 11/1943 | Fed. Rep. of Germany | 135/78 |
| 808608 | 7/1951 | Fed. Rep. of Germany | 135/81 |

OTHER PUBLICATIONS

*Illustrated Encyclopedia of Science and Technology–How Does It Work?*, vol. 2, pp. 233–234, ©1977.

Strasser, Federics; 10 Ways to Employ Screw Mechanisms; *Mechanisms. Linkages and Mechanical Controls,* New York, 1965, pp. 182, 183.

*Primary Examiner*—David A. Scherbel

*Assistant Examiner*—Lan Mai

*Attorney, Agent, or Firm*—Merchant, Gould, Smith Edell, Welter and Schmidt

[57] ABSTRACT

The present invention is a walking assist device which comprises a shaft having a hand grip at one end and having an end piece at the other. A retractable member is positioned within the end piece and has a point at one end. The retractable member may be positioned in a first position such that the point protrudes from the end piece. The retractable member has a second position in which the point is retracted within the end piece. In an alternate embodiment, a locking mechanism is connected between the shaft and the retractable member to provide an alternately locked position in either the retracted or protruding position of the point.

3 Claims, 3 Drawing Sheets

NON-SLIP WALKING ASSIST DEVICE

FIELD OF THE INVENTION

The present invention relates to walking assist devices and in particular relates to non-slip or non-skid walking assist devices.

BACKGROUND OF THE INVENTION

Many walking assist devices are known in the prior art. The most common are canes, crutches, walkers and the like. The cane typically consists of a shaft having at one end a hand grip and at the other a padded surface to facilitate gripping the ground or floor. The padded surface also assists in preventing marking of a soft surface or floor. Multi-leg canes are also known in the prior art which have a plurality of padded end pieces which flare out from the center shaft to provide increased stability.

Another common walking assist device is a crutch usually used as a temporary assist device for people with injuries to their legs. Crutches also have one or more shafts which contact the ground and which may have a padded end piece to facilitate gripping and to prevent marring of the floor. A crutch may have a hand grip and a padded top piece which fits under the arm of the user.

Also known in the prior art are walkers and the like which typically consist of three or four legs attached at the top to a hand railing portion which can be alternately leaned upon or used to lift the walker and move it forward. The legs also typically have padded end pieces to facilitate gripping and to prevent marring of the floor.

Other walking assist devices are also known in the prior art. All of the walking assist devices in the prior art have a common goal of stabilizing a frail person. The variety of frailties are many fold; however, the common feature is to minimize exhaustion of the walking person and to prevent falling. The padded end pieces on the walking assist device aid in preventing slipping of the device on dry surfaces. Usually the end pieces are selected from a resilient material such as rubber which aids in gripping in wet or dry surfaces. The resiliency of the end pieces, however, fails to provide traction on some surfaces making the use of the walking assist devices treacherous. In situations such as attempting to walk on ice with a walking assist device, the walking assist device may lose its traction causing the person to fall and become injured. Thus, the walking assist devices in some situations such as slippery or icy surfaces become unusable or hazardous.

SUMMARY OF THE INVENTION

The aforementioned shortcomings of the prior art and other shortcomings of the prior art which will become known to those skilled in the art upon reading and understanding the present specification are cured by the present invention. The present invention is a walking assist device which comprises a shaft having a hand grip at one end and having an end piece at the other. A retractable member is positioned within the end piece and has a point at one end. The retractable member may be positioned in a first position such that the point protrudes from the end piece. The retractable member has a second position in which the point is retracted within the end piece. In an alternate embodiment, a locking mechanism is connected between the shaft and the retractable member to provide an alternately locked position in either the retracted or protruding position of the point.

IN THE DRAWINGS

Figure 7:
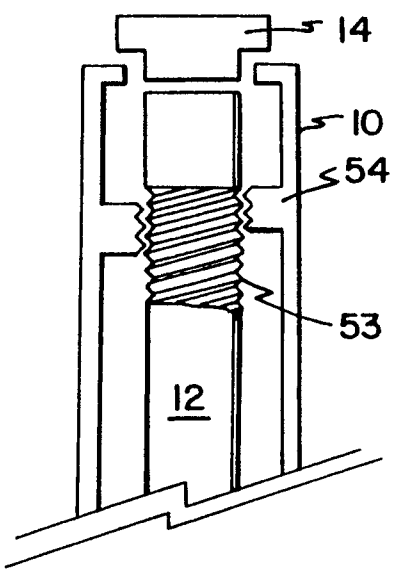

FIG. 7 discloses a mechanism for locking the point in a retracted or extended position which may be used in the present invention.

DETAILED DESCRIPTION OF THE PREFERRED EMBODIMENT

In the following detailed description of the preferred embodiments, reference is made to the accompanying drawings which form a part hereof and in which is shown by way of illustration a specific embodiment in which the invention may be practiced. This embodiment is described in sufficient detail to enable those skilled in the art to practice the invention, and it is to be understood that other embodiments may be utilized and that structural changes may be made without departing from the scope of the present invention. The following detailed description is, therefore, not to be taken in a limiting sense, and the scope of the present invention is defined by the appended claims.

Figure 1:
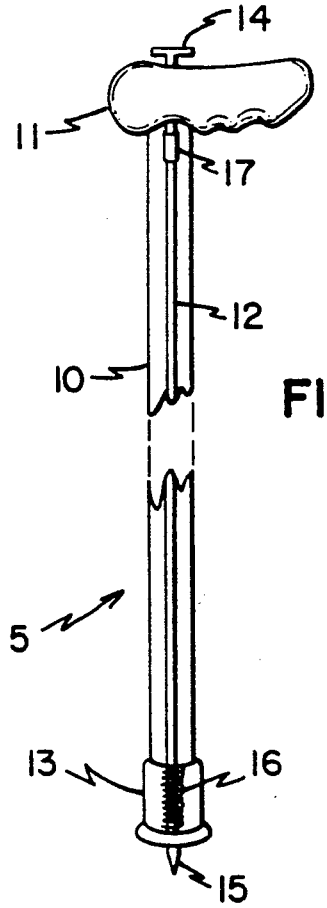
FIG. 1 shows a schematic mechanical drawing of a cane incorporating the present invention.

FIG. 1 is a mechanical schematic diagram of the present invention. FIG. 1 shows a cane with a hand grip at one end and a padded end piece at the other connected between a hollow shaft. Those skilled in the art will readily recognize that a wide variety of hollow or solid shaft configurations can be used with the present invention including a wide variety of end pieces and hand grips. The type of cane or walking assist device in general is not a limitation to the present invention.

A retractable member 12 is shown positioned within the hollow shaft 10 of the cane 5. A hand grip 11 is attached to the top of shaft 10 and a padded end piece 13 is connected at the other end of hollow shaft 10. Retractable member 12 has at one end at least one point 15 which can be made to protrude from the end of end piece 13. A positioning member 14 which in the preferred embodiment is a button attached to shaft 12 and which protrudes from the end of hand grip 11. A resilient member 16 such as a spring is positioned between shaft 10 and retractable member 12 to assist in retracting point 15. A locking mechanism 17 may be incorporated between hollows shaft 10 and retractable member 12 to lock point 15 alternately in the retracted or protruding position upon depressing of button 14. A wide variety of locking mechanisms may be used; however, a locking mechanism is not essential to the present invention. It may be sufficient that the user press and hold button 14 to cause point 15 to protrude from the end of end cap 13 to provide a gripping point when walking on a slippery surface. By releasing button 14, point 15 is retracted within end piece 13 thereby preventing any marring of the walking surface.

As a convenience feature, a locking mechanism 17 may be incorporated which allows the user to press button 14 once and cause the retractable point 15 to lock in a protruding or retracted position. Those skilled in the art will readily recognize that a wide variety of locking mechanisms may be used upon reading and understanding the present specification. The present invention is not intended to be limited by the specific locking mechanism used and the breath and scope of the present invention is defined only by the appended claims. A convenient form of a locking mechanism may be the type used in a retractable pen in which successive pressings of button 14 would cause locking mechanism 17 to rotate within hollow shaft 10 in alternately locked or unlocked positions.

Figure 2:
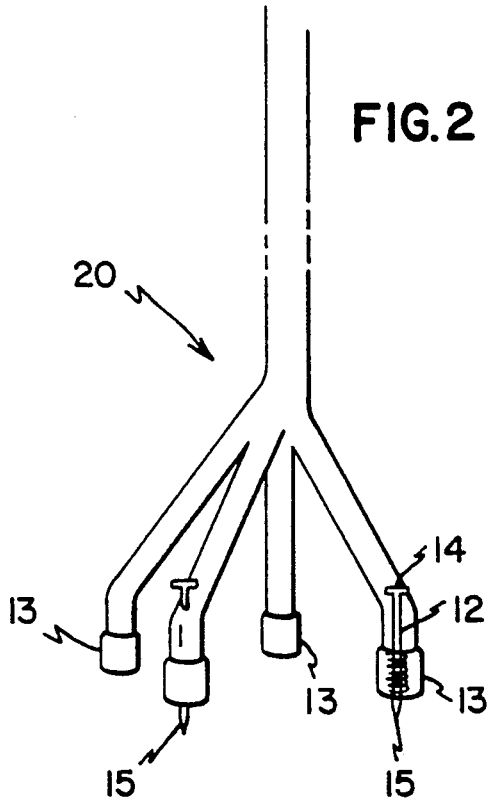
FIG. 2 shows the end portion of a multi-legged cane which incorporates an alternate embodiment of the present invention.

FIG. 2 describes an alternate embodiment of the present invention implemented in a multi-leg cane. In this embodiment, a plurality of retractable members are used to provide points which may be positioned to protrude from the end of end caps 13. Retractable members 12 may be constructed to be quite short and positioner 14 may be placed at the lower end of the multi-leg cane of FIG. 2. Positioning of point 15 may be facilitated by pressing positioner 14 with a person's foot.

Figure 3:
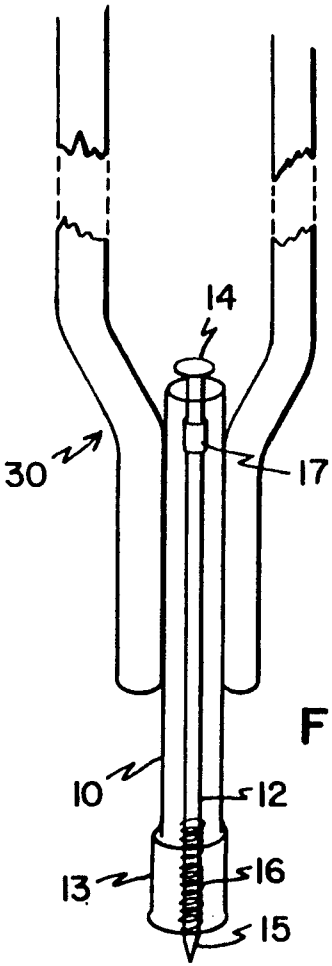
FIG. 3 shows a sectional schematic mechanical drawing of a crutch incorporating the present invention.

Another alternate embodiment is shown in FIG. 3 in which the present invention is incorporated in a crutch. Once again retractable member 12 is positioned within hollow shaft 10. The retractable member may include a position locking mechanism 17 as an option. Positioner button 14 may be conveniently located near the middle of the crutch to be operated by the user. A resilient member 16 may be incorporated anywhere between retractable member 12 and hollow shaft 10 to facilitate retracting of at least one point 15. Point 15 in the preferred embodiment protrudes only a quarter of an inch beyond the end of end cap 13. All that is required is a minimal protrusion of the point to facilitate gripping on icy or unstable surfaces.

Figure 4:
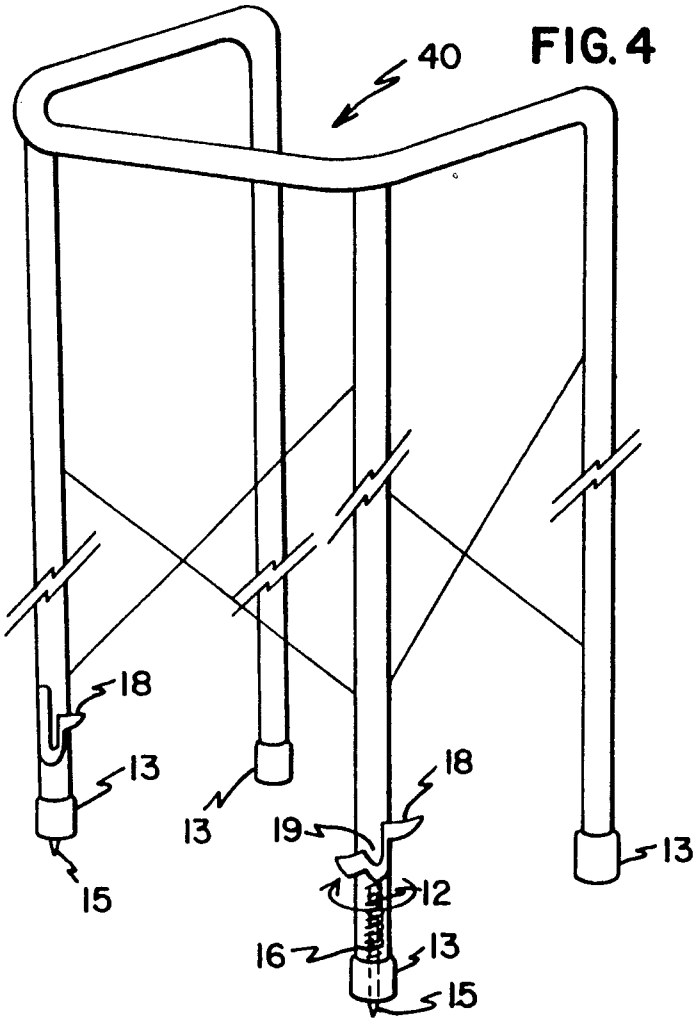
FIG. 4 shows a mechanical schematic drawing of a walker incorporating an alternate embodiment of the present invention.

Another alternate embodiment of the present invention is shown incorporated into the walker of FIG. 4. The walker also incorporates end caps 13 through which retractable members 12 present at least one point 15. An alternate positioner locking mechanism is described in FIG. 4 which may be manually operated. Locking mechanism 18 is shown having two positions corresponding to a retracted or protruding position of point 15. Locking mechanism 18 is placed between retractable member 12 and hollow shaft 10 of the walker leg. Locking positioner mechanism 18 moves between two positions of a slot 19 cut into hollow shaft 10 to allow movement of the point or points between a retracted and protruding position. The user manually changes position of locking positioner 18 from a first position to a lower second position in order to cause point 15 to protrude and lock in position.

Figure 6:
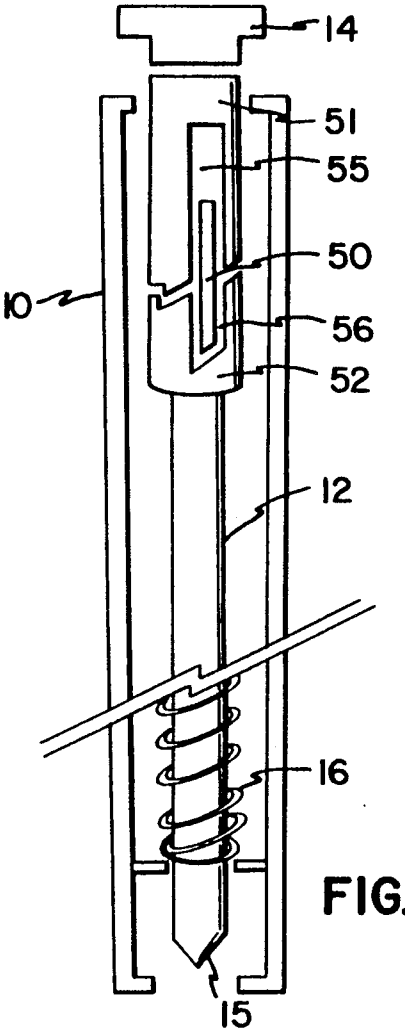
FIG. 6 shows a mechanical cut-away diagram of a locking mechanism which may be used in the present invention.
Figure 5:
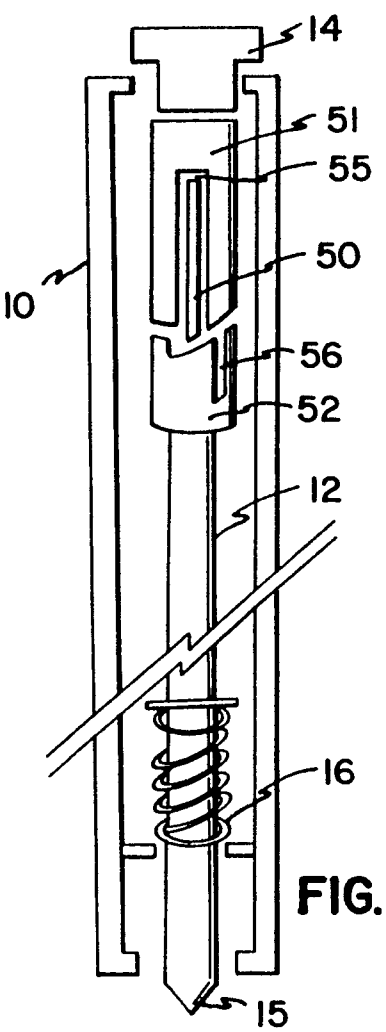
FIG. 5 shows a mechanical cut-away diagram of a locking mechanism which may be used in the present invention.

FIGS. 5 and 6 are mechanical cut-away diagrams of a locking mechanism which may be used in the present invention. FIG. 5 shows point 15 placed in the extended or protruding position while FIG. 6 shows point 15 placed in the retracted position. The retractable member 12 having end point 15 is extended and retracted by pressing positioning member 14 in a downward motion. Cylindrical thrust member 51 is connected to positioning member 14. Thrust member 51 has a slot 55 placed on the outer surface of cylindrical thrust member 51. Slot 55 slides on ridge 50 which is fixed to the inner surface of shaft 10. Thrust member 51 has a bottom ring of slopping rachet teeth which engage cap member 52. When thrust member 51 is pressed downward by positioning member 14, the slopping teeth of thrust member 51 cause cap member 52 and retractable member 12 to rotate within shaft 10. Cap member 52 also has a slot 56 which, when properly positioned, will slide on ridge 50. When thrust member 51 and cap member 52 are rotated by a downward motion on positioning member 14, end point 15 will lock in an extended or retracted position depending on whether slot 56 aligns itself with ridge 50.

In an alternate embodiment, FIG. 7 discloses a mechanism for locking point 15 in a retracted or extended position by rotating positioning member 14 causing threaded portion 53 of retractable member 12 to track threaded ridge 54 connected to shaft 10. In this fashion, rotating or screwing position member 14 in a clockwise or counterclockwise direction will cause point 15 to be either retracted or protruding.

In an alternate embodiment, the positioning member 14 may be attached to shaft 12 having a small projection on one side of shaft 12. Positioning member 12 is pressed downward to extend point 15 until the projection clicks into a hole in the shaft 10. Pressing the projection through the hole releases it and the point 15 is pulled back by means of resilient member 16.

While the present invention has been described in connection with the preferred embodiment thereof, it will be understood that many modifications will be readily apparent to those of ordinary skill in the art, and this application is intended to cover any adaptations or variations thereof. Therefore, it is manifestly intended that this invention be limited only by the claims and equivalents thereof.

What is claimed:

1. A slip-resistent walking assist device, comprising:

a shaft having a hand grip at one end and having a padded end piece at the other end;

a retractable member having a point at one end, said member positioned within said shaft and having a first position such that said point protrudes from the end of said end piece and having a second position such that said point is retracted within said end piece;

positioner means connected between said shaft and said retractable member for alternately positioning said point in either said first or second positions said positioner means further includes a locking mechanism to place said retractable member in either the first or second positions; and said locking mechanism includes a first cylindrical member connected to said positioner means having a slot in the surface thereof sized to receive a projection from said shaft and a cap member connected to said retractable member also having a seat in the surface thereof to receive said projection whereby said cap member rotates upon a downward pressure on said positioner means causing said projection to alternately be placed into said slot of said cap member causing said point to be alternately placed in said first or second positions.

2. The device according to claim 1 wherein said device includes a plurality of shafts to form the legs of a walker and which incorporates at least one retractable member.

3. The device according to claim 1 wherein said retractable member has a plurality of points at one end.

* * * * *